US009185983B1

(12) United States Patent
Cohen

(10) Patent No.: US 9,185,983 B1
(45) Date of Patent: Nov. 17, 2015

(54) FOLDING LOUNGE CHAIR WITH BACKPACK STRAPS

(71) Applicant: Warren Cohen, Philadelphia, PA (US)

(72) Inventor: Warren Cohen, Philadelphia, PA (US)

(73) Assignee: Rio Brands, LLC, Philadelphia, PA (US)

( * ) Notice: Subject to any disclaimer, the term of this patent is extended or adjusted under 35 U.S.C. 154(b) by 0 days.

(21) Appl. No.: 14/267,033

(22) Filed: May 1, 2014

Related U.S. Application Data

(63) Continuation-in-part of application No. 13/470,295, filed on May 12, 2012.

(60) Provisional application No. 61/485,605, filed on May 12, 2011.

(51) Int. Cl.
*A47C 4/52* (2006.01)
*A47C 4/28* (2006.01)

(52) U.S. Cl.
CPC .... *A47C 4/52* (2013.01); *A47C 4/28* (2013.01)

(58) Field of Classification Search
CPC ..... A47C 4/34; A47C 4/44; A47C 4/10; A47C 4/20; A47C 4/52; A47C 4/28
USPC ..... 297/17, 30, 70, 76
See application file for complete search history.

(56) References Cited

U.S. PATENT DOCUMENTS 3,179,465 A * 4/1965 Roberts ..... 297/17
3,309,134 A * 3/1967 Roberts ..... 297/17
3,885,722 A * 5/1975 Robertson ..... 224/261
4,577,901 A * 3/1986 Phillips ..... 297/17
4,676,548 A * 6/1987 Bradbury ..... 297/129
4,773,708 A * 9/1988 Nastu ..... 297/423.36
4,889,383 A * 12/1989 Jones ..... 297/16.1
5,246,265 A 9/1993 Nagan et al.
5,429,413 A 7/1995 Levy et al.
5,538,318 A * 7/1996 MacLean ..... 297/129
5,544,793 A * 8/1996 Harrop ..... 224/645
5,588,696 A * 12/1996 Jay et al. ..... 297/129
6,062,648 A 5/2000 Adler
6,250,712 B1 * 6/2001 Livington et al. ..... 297/4
6,764,132 B1 * 7/2004 Gaertner ..... 297/183.5
6,817,666 B1 * 11/2004 Blount ..... 297/272.2
D587,023 S * 2/2009 Aaron et al. ..... D6/335
7,963,592 B1 * 6/2011 Stanley ..... 297/31
8,002,349 B1 * 8/2011 Pizzuto ..... 297/217.3
8,197,000 B1 * 6/2012 Cohen ..... 297/17
2003/0080592 A1 * 5/2003 Isom et al. ..... 297/16.2
2008/0036256 A1 * 2/2008 Gold et al. ..... 297/255
2009/0256401 A1 * 10/2009 Hensley ..... 297/17
2013/0082505 A1 * 4/2013 Schneider et al. ..... 297/452.19

* cited by examiner

*Primary Examiner* — David R Dunn
*Assistant Examiner* — Timothy J Brindley
(74) *Attorney, Agent, or Firm* — LaMorte & Associates, P.C.

(57) ABSTRACT

A folding lounge chair that is selectively configurable between an open configuration and a folded configuration. The folding lounge chair has a seat section, a backrest section, and a leg support section. A first leg assembly and a second leg assembly are both pivotably connected to the seat section. The two leg assemblies are folded into a common plane that is flush against the seat section when the lounge chair is in its folded configuration. Shoulder straps are anchored to the seat section. The shoulder straps can be selectively opened between ends. This enables the shoulder straps to pass over the leg assemblies when in the folded configuration and pass under both the leg assemblies when the folding lounge chair is in the open configuration.

15 Claims, 5 Drawing Sheets

FOLDING LOUNGE CHAIR WITH BACKPACK STRAPS

RELATED APPLICATIONS

This application is a continuation-in-part of U.S. patent application Ser. No. 13/470,295 filed May 12, 2012, which claims the priority of U.S. provisional patent application No. 61/485,605, filed May 12, 2011, the disclosures of which are incorporated into this specification by reference.

BACKGROUND OF THE INVENTION

1. Field of the Invention

In general, the present invention relates to the structure of folding chairs that can be carried as backpacks. More particularly, the present invention relates to folding chairs configured as loungers that can provide full support to elevated legs.

2. Prior Art Description Many people carry folding chairs to the beach, parks, and other outdoor destinations. Typically, the folding chair is a simple small chair. However, some people would prefer the comfort of a larger lounge-style chair that provides support to the legs. Although many lounge chair designs exist, most are too large and too bulky to be comfortably carried for any significant period of time. Accordingly, lounge-style chairs are rarely transported farther than from the house to the backyard patio, or from the car to the beach.

In the prior art, there are many lounge chairs that fold into smaller sizes. Typically, a lounge chair has a backrest that can fold flush against the seat of the lounger. Such folding abilities make the lounge chairs easier to store and stack when not in use. Such lounge chairs are exemplified by U.S. Pat. No. 5,246,265 to Nagan, entitled Lounge Chair. Although such prior art lounge chairs can be folded to some degree, the lounge chairs remain very bulky and difficult to transport.

Recognizing the problem of transporting lounge chairs, some manufacturers have designed lounge chairs that collapse into very small sizes. The collapsed lounge chair can then be carried in a bag. Such prior art collapsible lounge chairs are exemplified by U.S. Pat. No. 5,429,413 to Levy, entitled Folding Lounge Chair and U.S. Pat. No. 6,062,648 to Adler, entitled Foldable Lounge Chair. The problem associated with such prior art lounge chairs is that the lounge chairs must be removed from the carry bag every time they are used and returned to the carry bag whenever they are to be transported. The need to transport the folding lounge chair in a bag makes such prior art chairs inconvenient to use.

A need exists for a collapsible lounge chair that is specifically designed to be carried by a user, hands free. A need also exists for a collapsible lounge chair that can be carried hand free, yet requires no carry bag. Such a collapsible lounge chair needs to be lightweight and collapsible into a convenient size and have lifting features that enable the chair to be comfortably carried for long distances. These needs are met by the present invention as described below.

SUMMARY OF THE INVENTION

The present invention is a folding lounge chair that is selectively configurable between an open configuration and a folded configuration. The folding lounge chair has a seat section, a backrest section and a leg support section. The backrest section and the leg support section are joined to the seat section by hinge connections. The hinge connections enable both the leg support section to be folded over the seat section and the backrest section to be folded atop the leg support section.

A first leg assembly and a second leg assembly are both pivotably connected to the seat section. The first leg assembly and the second leg assembly can both be extended away from the seat section when the lounge chair is in its open configuration. The two leg assemblies can also be folded into a common plane that is flush against the bottom surface of the seat section when the lounge chair is in its folded configuration.

At least one shoulder strap is anchored to the bottom surface of the folding lounge chair. The shoulder strap contains a clip connector that enables the shoulder strap to be opened between its ends. This enables the shoulder strap to pass over both the first leg assembly and the second leg assembly when the folding lounge chair is in the folded configuration and pass under both the first leg assembly and the second leg assembly when the folding lounge chair is in the open configuration.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention folding lounge chair can be embodied in many ways, only one exemplary embodiment of the folding lounge chair is illustrated. The exemplary embodiment is selected in order to set forth one of the best modes contemplated for the invention. The illustrated embodiment, however, is merely exemplary and should not be considered a limitation when interpreting the scope of the appended claims.

Figure 1:
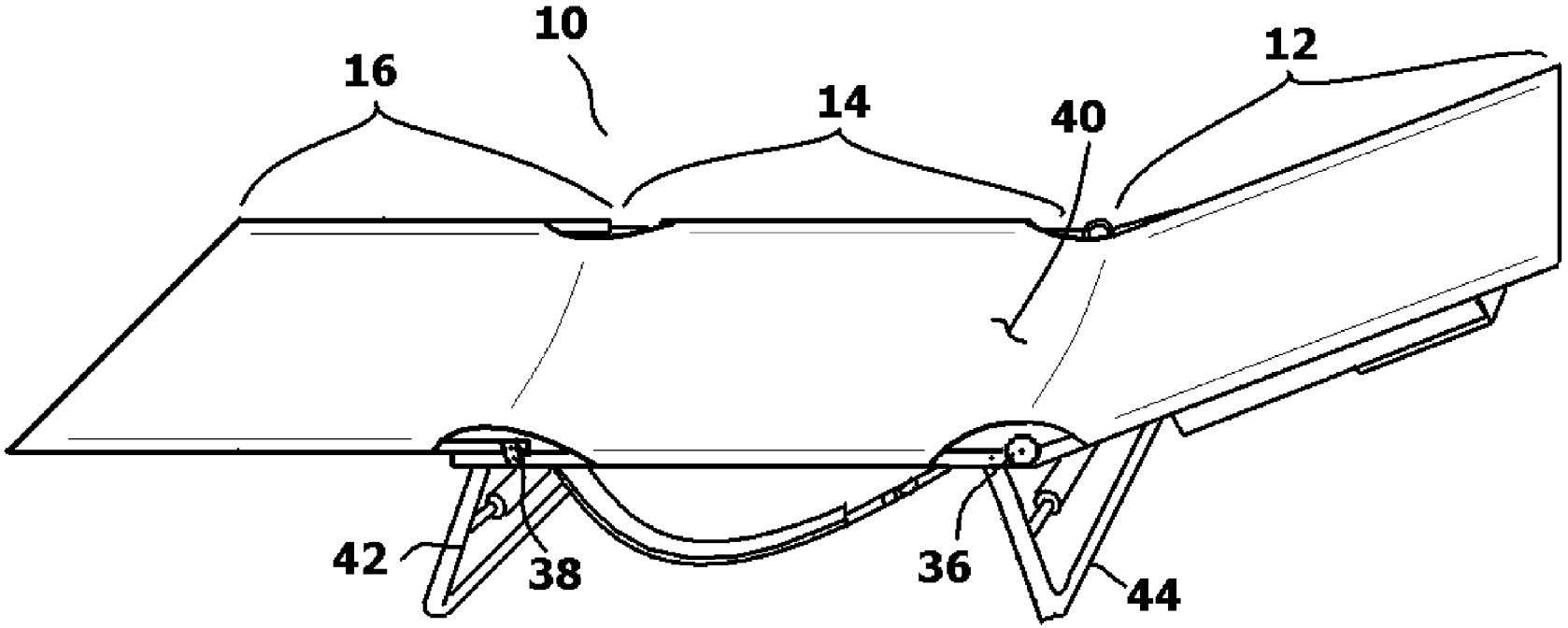
FIG. 1 is a top perspective view of an exemplary embodiment of a folding lounge chair assembly in an open configuration.
Figure 2:
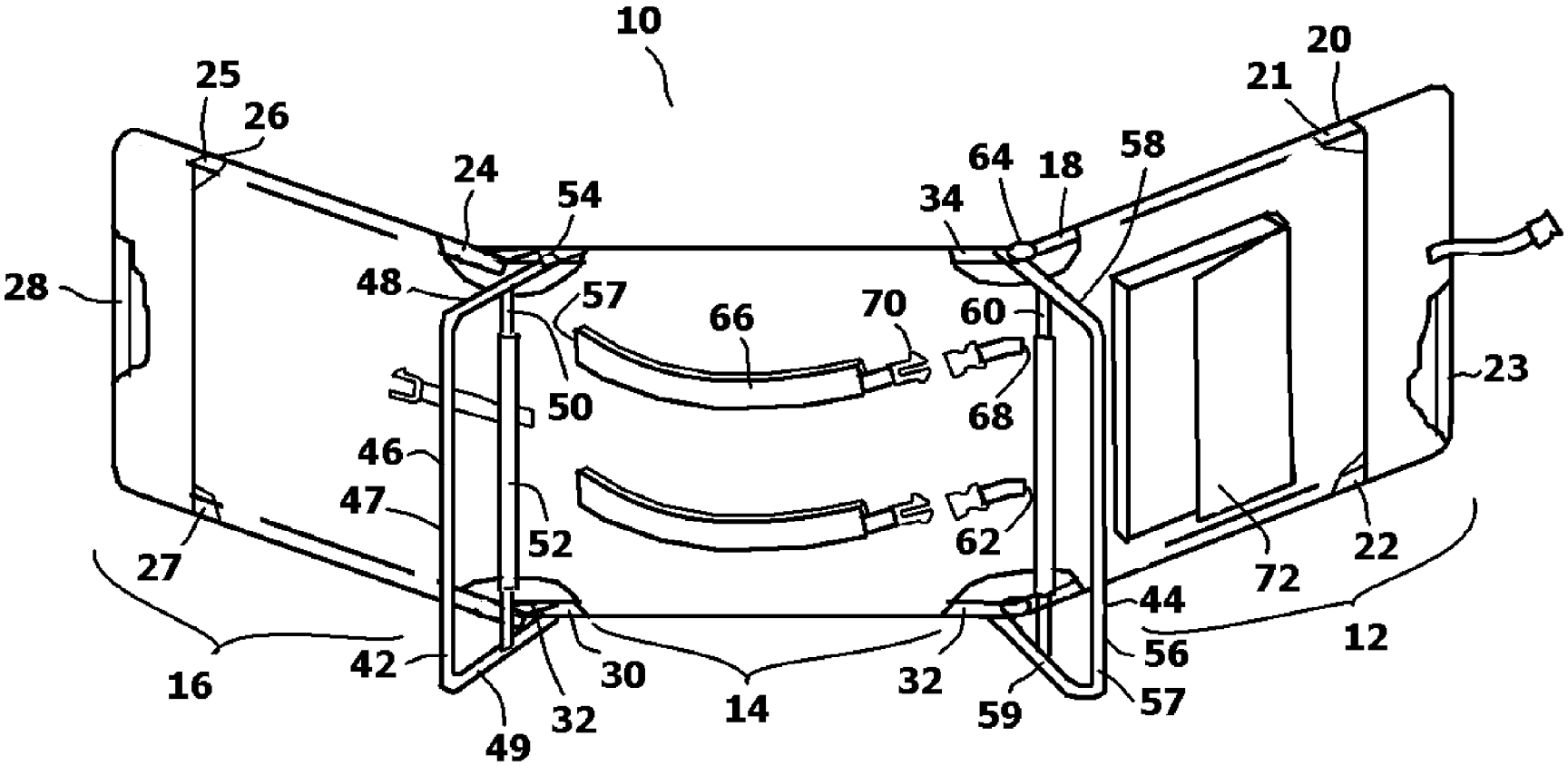
FIG. 2 is a bottom perspective view of the exemplary embodiment of the folding lounge chair assembly shown in an open configuration.

Referring to both FIG. 1 and FIG. 2, a lounge chair assembly 10 is shown. The lounge chair assembly 10 has three sections. The three sections include a backrest section 12, a seat section 14, and a leg support section 16. When the lounge chair assembly 10 is in a fully open configuration, a person can sit upon the seat section 14, lean against the backrest section 12, and have his/her feet resting upon the leg support section 16.

The backrest section 12 has a framework 18 that is fabricated from a U-shaped tube 20. The U-shaped tube 20 has two side frame elements 21, 22 and a cross element 23. Likewise, the leg support section 16 has a framework 24 that is fabricated from a U-shaped tube 25 that has two side elements 26, 27 and a cross element 28. The seat section 14 has a framework 30 that consists of only two parallel frame elements 32, 34. The side frame elements 32, 34 of the seat framework 30 connect to the two side frame elements 21, 22 of the backrest framework 18 with a first set of ratchet hinge assemblies 36. The ratchet hinge assemblies 36 enable the backrest framework 18 to be folded flush over the top of the seat section 14. The ratchet hinge assemblies 36 also enable the backrest framework 18 to be set at a variety of angles relative the seat section 14, when the lounge chair assembly 10 is in use.

Likewise, the opposite ends of the side frame elements 32, 34 of the seat framework 30 connect to the two side frame elements 26, 27 of the leg support framework 24 with a second set of hinge assemblies 38. The second set of hinge assemblies 38 enable the leg support framework 24 to be folded flush over the top of the seat framework 30. The second set of hinge assemblies 38 also enable the leg support framework 24 to be set at a variety of angles relative the seat framework 30.

In the shown embodiment, it will be understood that fabric is stretched across the backrest framework 18, the seat framework 30 and the leg support framework 24 to produce the backrest section 12, the seat section 14, and the leg support section 16 of the lounge chair assembly 10, respectively. The fabric being illustrated is a single fabric panel 40. However, it will be understood that three separate panels can also be used.

The backrest section 12, seat section 14 and leg support section 16 are all supported above the ground by the same two leg subassemblies 42, 44. Both of the leg subassemblies 42, 44 attach to the seat framework 30 and elevate the seat framework 30 above the ground. The backrest framework 18 and the leg support framework 24 are elevated due to their attachment to the seat framework 30. The leg subassemblies 42, 44 include a front leg subassembly 42 and a rear leg subassembly 44. The front leg subassembly 42 supports the seat framework 30 near the second set of hinge assemblies 38. The front leg subassembly 42 has a U-shaped element 46. The U-shaped element 46 has a base bar 47 and two arms 48, 49. The U-shaped element 46 is made more rigid by use of a crossbar element 50 that extends between the two arms 48, 49 in parallel to the base bar 47. The crossbar element 50 preferably contains external padding 52 for reasons that are later explained. The arms 48, 49 of the U-shaped element 46 are connected to the two frame elements 32, 34 of the seat framework 30 with a first set of hinge connections 54. The hinge connections 54 enable the front leg subassembly 42 to be selectively folded against the bottom of the seat section 14. It also enables the front leg subassembly 42 to be rotated into a deployed position where the front leg subassembly 42 extends a first length from the seat section 14 and elevates the seat section 14 above the ground.

Likewise, the leg subassemblies include a rear leg subassembly 44. The rear leg subassembly 44 supports the seat framework 30 near the first set of ratchet hinge assemblies 36. The rear leg subassembly 44 has a U-shaped element 56. The U-shaped element 56 has a base bar 57 and two side arms 58, 59. The U-shaped element 56 is made more rigid by the use of a crossbar element 60 that extends between the arms 58, 59. This crossbar element 60 also preferably contains padding 62. The arms 58, 59 of the U-shaped element 56 are connected to the two frame elements 32, 34 of the seat framework 30 with a second set of hinge connections 64. The second set of hinge connections 64 enable the rear leg subassembly 44 to be selectively folded against the bottom of the seat section 14. It also enables the rear leg subassembly 44 to be rotated into a deployed position where the rear leg subassembly 44 extends a second length from the seat section 14 and helps elevate the seat section 14 above the ground.

In the illustrated embodiment, two generally parallel shoulder straps 66 are provided. However, it should be understood that a single, diagonally positioned shoulder strap could also be used in place of the two shoulder straps. Both configurations are intended. However, two shoulder straps 66 are illustrated to present the most stable configuration for the invention.

The shoulder straps 66 are connected to the fabric panel 40 on the underside of the lounge chair assembly 10. The shoulder straps 66 are shown connected to the seat section 14. However, the shoulder straps can also be connected to the backrest section and/or the leg support section near the seat section 14. Each shoulder strap 66 has two ends 67, 68. The two ends 67, 68 are sewn, or otherwise affixed to the seat section 14. However, a clip connector 70 is disposed between the two ends 67, 68. The clip connector 70 enables each of the shoulder straps 66 to be selectively opened and closed between its two ends 67, 68.

A pouch 72 is provided. The pouch 72 has an open top with a flap 74 that can be closed over the open top. The pouch 72 is affixed to the underside of the backrest section 12. The pouch 72 may contain one or more smaller pockets in its exterior surfaces. Furthermore, the pouch 72 may be insulated to hold hot or cold material.

Figure 3:
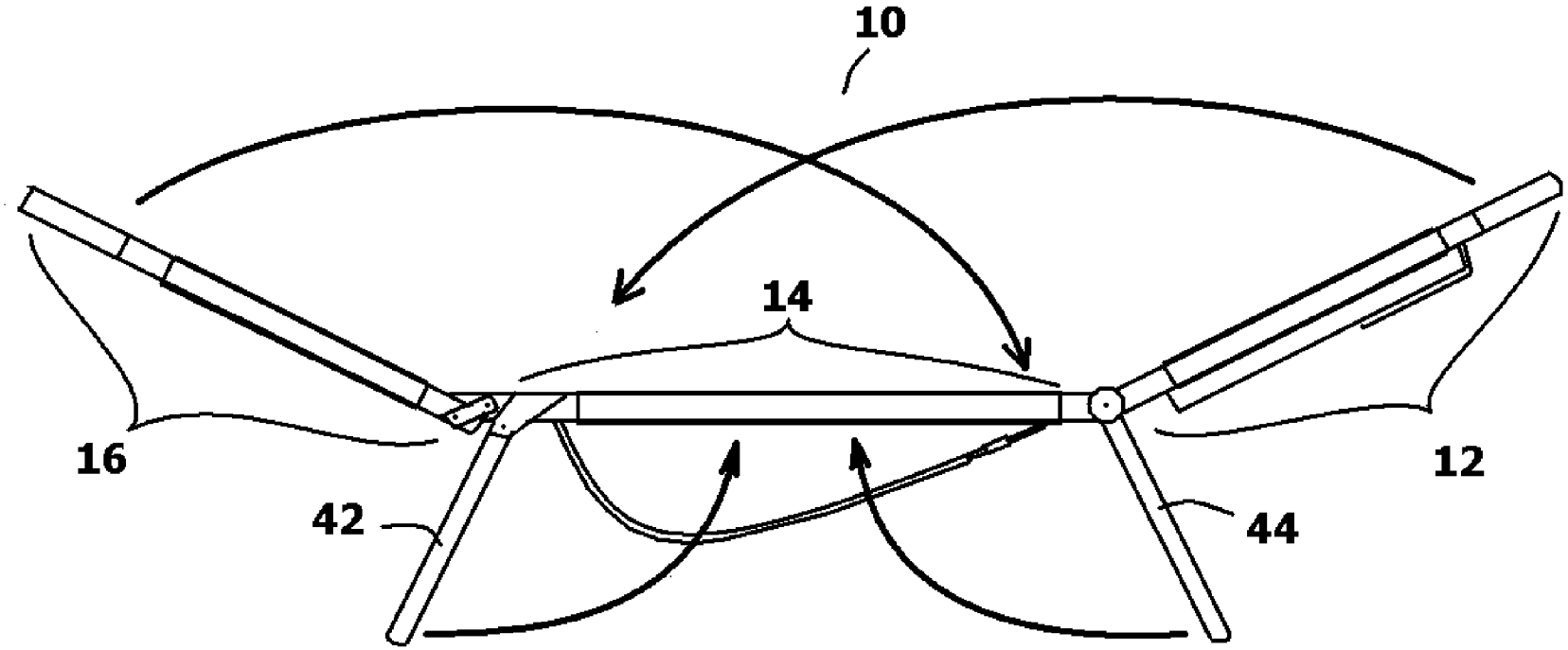
FIG. 3 is a side view showing the folding action of the folding lounge chair assembly.
Figure 4:
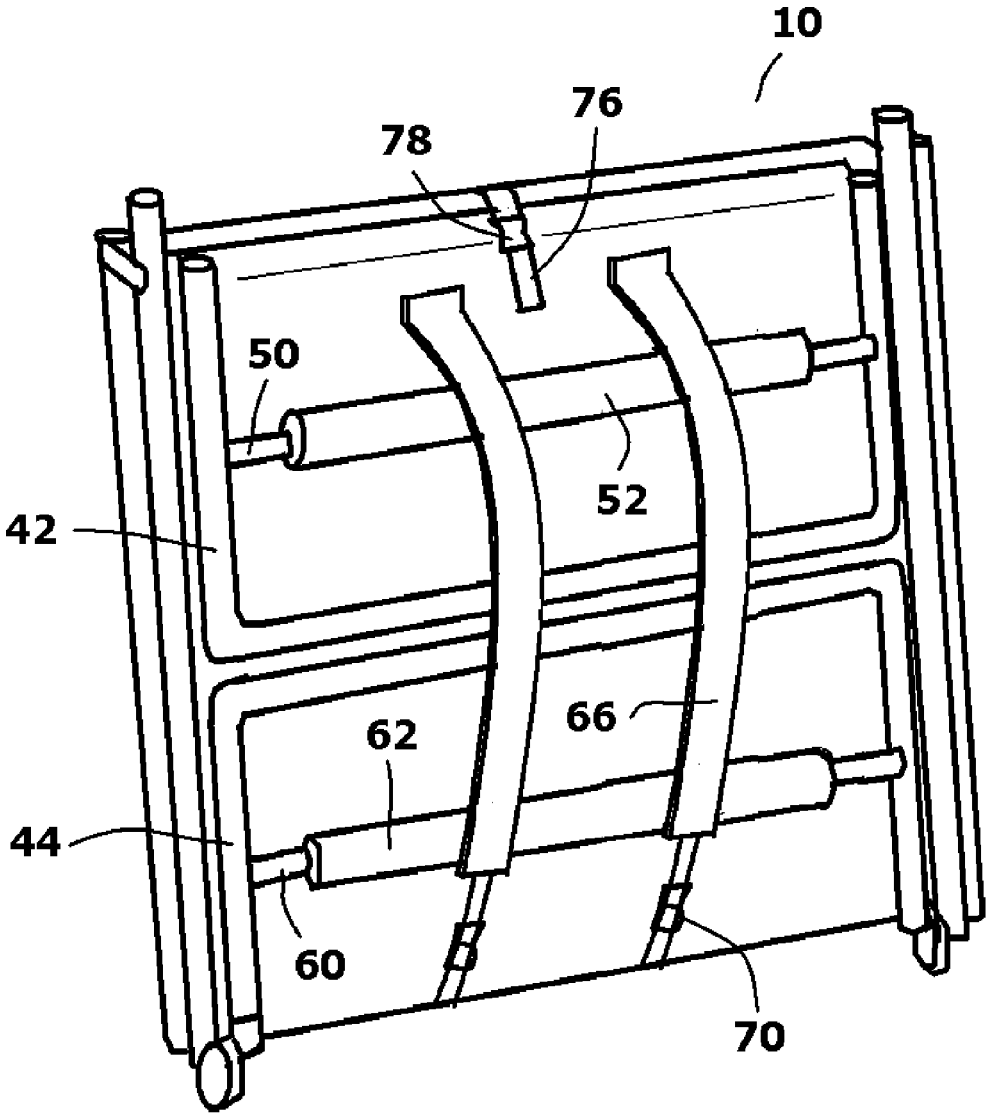
FIG. 4 shows a front perspective view of the folding lounge chair in a fully folded configuration.

Referring to FIG. 3 and FIG. 4 in conjunction with earlier figures, it can be seen that the lounge chair assembly 10 can be folded from an open configuration (FIG. 1) to a folded configuration (FIG. 4). To alter the configuration of the lounge chair assembly 10, the leg support section 16 is first folded flush against the top of the seat section 14. The backrest section 12 is then folded flush against the top of the leg support section 16. The seat section 14, leg support section 16 and backrest section 12 are generally parallel with the leg support section 16 being interposed between the seat section 14 and the backrest section 12.

The front leg subassembly 42 and the rear leg subassembly 44 are folded against the bottom of the seat section 14. As can be seen from FIG. 4, the leg subassemblies 42, 44 are sized so that the leg subassemblies 42, 44 do not overlap when folded flush against the seat section 14. Rather, both leg subassemblies 42, 44 lay flush in the same plane. The crossbar elements 50, 60 on the leg subassemblies 42, 44 are padded. This makes the crossbar elements 50, 60 the thickest parts of the leg subassemblies 42, 44. Accordingly, when the leg subassemblies 42, 44 are folded flush against the seat section 14, the padding 52, 62 on the crossbar elements 50, 60 are the contact surfaces that extend the furthest away from the seat section 14 and closest to the shoulder straps 66.

Normally, the folding of the leg subassemblies 42, 44 into their folded configuration would entrap the shoulder straps 66. To prevent this condition from happening, the clip connectors 70 on the shoulder straps 66 are opened and the shoulder straps 66 are pulled over the crossbar elements 50, 60. The clip connectors 70 are then closed. This repositions the shoulder straps 66 over the top of the crossbar elements 50, 60 that the shoulder straps 66 hang freely. In theory, the shoulder straps can be made very large so that the leg subassemblies 42, 44 can open and close within the confines of the shoulder strap. However, this makes the shoulder straps too long to be practical. It also wastes material. The better solution is to have the shoulder straps 66 properly sized for comfort. The clip connectors 70 enable the shoulder straps 66 to be opened so that the leg subassemblies 42, 44 and be extended.

Closure straps 76 are provided on both the seat section 14 and the backrest section 12. Each of these closure straps 76 also have a clip connector 78 that enables the closure straps 76 to be opened and closed. The clip connector 78 on both closure straps 76 is closed to lock the lounge chair assembly 10 into its folded configuration.

Figure 5:
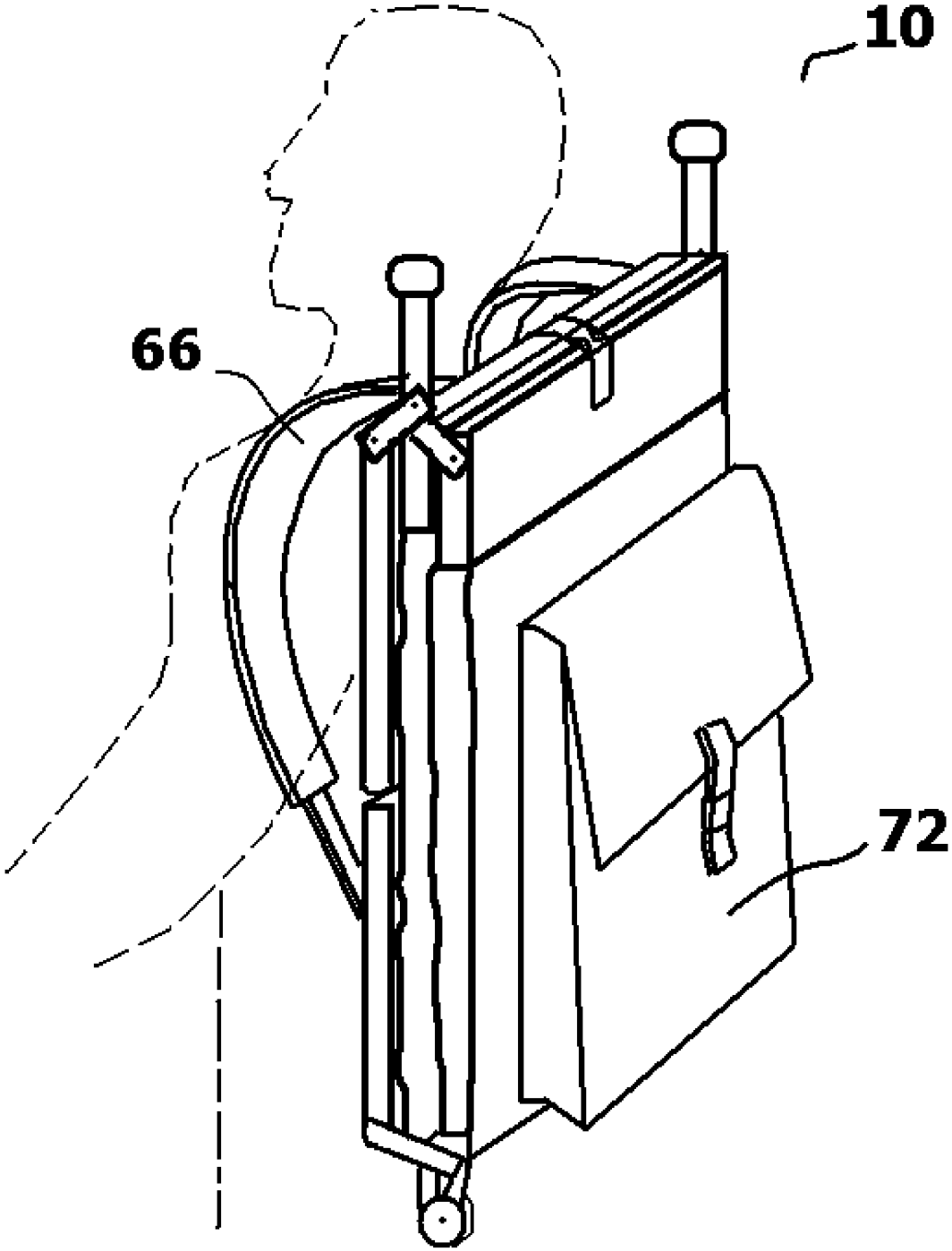
FIG. 5 shows a perspective view of the exemplary embodiment of the folding lounge chair assembly shown in a fully folded configuration and being carried as a backpack.

Referring to FIG. 5 in conjunction with FIG. 4, it will be understood that once the lounge chair assembly 10 is locked into its folded configuration, it can be transported as a backpack. To be worn as a backpack, the shoulder straps 66 are worn about a person's shoulders. This causes the person's back to contact the padded crossbar elements 50, 60 of the leg subassemblies 42, 44, which extend closest the shoulder straps 66. The padding 52, 62 on the crossbar elements 50, 60 make the lounge chair assembly 10 comfortable to transport as a backpack. Furthermore, the crossbar elements 50, 60 are positioned to stretch across the shoulders and lower back of the person carrying the lounge chair assembly 10 as a backpack. These points of contact are preferred and minimize any discomfort causes by contact with the leg subassemblies 42, 44.

From FIG. 5, it can also be seen that when the lounge chair assembly 10 is in its folded configuration and is being worn as a backpack, the pouch 72 is positioned in an upright position at the rear of the lounge chair assembly 10. This enables the pouch 72 to perform as a backpack compartment. When the lounge chair assembly 10 is worn as a backpack, the pouch 72 is properly oriented to serve as a backpack. Secondary items can therefore be stored and carried in the pouch 72 as the lounge chair assembly 10 is being carried. Thus, the lounge chair assembly 10 not only can be carried as a backpack, but it can be used as a backpack to carry other items.

When the lounge chair assembly 10 is worn as a backpack, the lounge chair assembly is carried hands free. That is, the lounge chair assembly is supported by the shoulder straps and the person's hands are free. Furthermore, since the lounge chair assembly 10 can function as a backpack, it can carry many additional items while still leaving the user's hands free. This is a unique utility function that makes the lounger chair assembly 10 very useful when transporting many objects to places likes parks and beaches.

It will be understood that the embodiment of the present invention being illustrated is merely exemplary and that a person skilled in the art can make many variations to that embodiment. For example, the length, width and height of the lounge chair assembly can be varied as desired. Likewise, any number of pockets can be sewn into the fabric panel and pouch. Furthermore, the two shoulder straps can be replaced with a single diagonal strap. All such variations and alternate embodiments are intended to be included within the scope of the present invention.

What is claimed is:

1. A folding lounge chair that is selectively configurable between an open configuration and a folded configuration, said folding lounge chair comprising:

a seat section, a backrest section and a leg support section, said seat section having a top surface and a bottom surface, wherein said backrest section and said leg support section are joined to said seat section by hinge connections, and wherein said hinge connections enable both said leg support section to be folded over said top surface of said seat section and said backrest section to be folded atop said leg support section when in said folded configuration;

a first leg assembly pivotably connected to said seat section and a second leg assembly pivotably connected to said seat section, wherein said first leg assembly and said second leg assembly can both be extended away from said seat section when in said open configuration and folded into a common plane that is flush against said bottom surface of said seat section when in said folded configuration;

a first shoulder strap having a first end anchored to said bottom surface of said seat section and a second end that is anchored to said bottom surface of said seat section, wherein said first shoulder strap contains a first clip connector that enables said first shoulder strap to be opened between said first end and said second end, therein enabling said first shoulder strap to pass over both said first leg assembly and said second leg assembly when in said folded configuration and pass under both said first leg assembly and said second leg assembly when in said open configuration;

a second shoulder strap having a first end anchored to said bottom surface of said seat section and a second end that is anchored to said bottom surface of said seat section, wherein said second shoulder strap contains a second clip connector that enables said second shoulder strap to be opened between said first end and said second end, therein enabling said second shoulder strap to pass over both said first leg assembly and said second leg assembly when in said folded configuration and pass under both said first leg assembly and said second leg assembly when in said open configuration.

2. The lounge chair according to claim 1, wherein said first leg assembly includes a first U-shaped element with a first base bar and two arms, wherein a first crossbar extends laterally between said arms in an orientation that is parallel to said first base bar, and wherein both said first shoulder strap and said second shoulder strap pass under said first crossbar when in said open configuration and over said first base bar when in said folded configuration.

3. The lounge chair according to claim 2, wherein said second leg assembly includes a second U-shaped element with a second base bar and a second crossbar, wherein both said first shoulder strap and said second shoulder strap pass under said second crossbar when in said open configuration and over said second base bar when in said folded configuration.

4. The lounge chair according to claim 1, further including closure straps for retaining said folding lounge chair in said folded configuration.

5. The lounge chair according to claim 1, further including a pouch affixed to said backrest section, wherein said pouch is fully exposed and accessible, when said folding longer is in said folded configuration.

6. The folding lounge chair according to claim 3, wherein said first crossbar and said second crossbar are at least partially covered in padding.

7. The folding lounge chair according to claim 1, wherein said seat section includes two parallel frame elements and a fabric panel that is stretched taut between said frame elements, wherein both said first shoulder strap and said second shoulder strap are anchored to said fabric panel.

8. A folding lounge chair having an open configuration and a folded configuration, said folding lounge chair assembly comprising:

a seat section, a backrest section and a leg support section, said seat section having a bottom surface, wherein said seat section is supported by folding leg assemblies, and wherein said leg support section is foldable over said seat section and said backrest section is foldable over said leg support section when in said folded configuration;

shoulder straps anchored to said bottom surface of said seat section, wherein said shoulder straps pass over said folding leg assemblies when said lounge chair is in said folded configuration and wherein each of said shoulder straps has a first end that is coupled to said bottom surface of seat section, a second end that is coupled to said bottom surface of said seat section, and a connector clip that can selectively open each of said shoulder straps between said first end and said second end.

9. The lounge chair according to claim 8, wherein said shoulder straps pass under said folding leg assemblies when said lounge chair is in said open configuration.

10. The lounge chair according to claim 8, wherein said leg assemblies lay in a common plane that is parallel to said bottom surface of said seat section when said lounge chair is in said folded configuration.

11. The lounge chair according to claim 10, wherein each of said leg assemblies contains at least one padded surface that faces said shoulder straps when said lounge chair is in said folded configuration.

12. The lounge chair according to claim 8, wherein each of said leg assemblies includes a U-shaped element with a base bar and two arms, wherein a crossbar extends laterally between said arms in an orientation that is parallel to said base bar, and wherein said shoulder straps pass under said crossbar when in said open configuration and pass over said crossbar when in said folded configuration.

13. The lounge chair according to claim 8, further including closure straps for retaining said folding lounge chair in said folded configuration.

14. The lounge chair according to claim 8, further including a pouch affixed to said backrest section, wherein said pouch is fully exposed and accessible, when said folding lounge chair is in said folded configuration.

15. The lounge chair according to claim 8, wherein said seat section includes two parallel frame elements and a fabric panel that is stretched taut between said frame elements, wherein said shoulder straps are anchored to said fabric panel.

* * * * *